United States Patent [19]

Szabó

[11] Patent Number: 4,514,227

[45] Date of Patent: Apr. 30, 1985

[54] METHOD OF MANUFACTURING A FOUNDRY MOULD MIX CONTAINING A MOULD BINDER

[75] Inventor: Ervin I. Szabó, Manotic, Canada

[73] Assignee: Canadian Patents and Development Limited, Ottawa, Canada

[21] Appl. No.: 579,452

[22] Filed: Feb. 13, 1984

Related U.S. Application Data

[63] Continuation-in-part of Ser. No. 419,506, Sep. 19, 1982, abandoned.

[30] Foreign Application Priority Data

Dec. 11, 1981 [CA] Canada ..... 392120

[51] Int. Cl.[3] ..... B28B 7/36

[52] U.S. Cl. ..... 106/38.2; 164/525

[58] Field of Search ..... 106/38.2; 164/525

[56] References Cited

U.S. PATENT DOCUMENTS

| | | | |
|---|---|---|---|
| 2,086,499 | 7/1937 | Hennig | 260/448 R |
| 2,289,286 | 7/1942 | Mazabraud | 260/448 R |
| 3,014,055 | 12/1961 | Johnson | 424/315 |
| 4,108,981 | 8/1978 | Muhler et al. | 424/55 |

OTHER PUBLICATIONS

Kirk-Othmer, *Ency. of Chem. Tech.*, 1970, vol. 22, p. 606.

*Primary Examiner*—Lorenzo B. Hayes

*Attorney, Agent, or Firm*—Francis W. Lemon

[57] ABSTRACT

A foundry mould binder is manufactured by mixing at least one monobasic acid selected from the group consisting of formic acid, acetic acid, propiolic acid, propionic acid, and acrylic acid, with a precipitant for the acid, and water, the water being present in an amount no greater than 1.5 times the weight of the total acid content, calculated on that acid content being in a water free state. The precipitant contains the equivalent to at least 50% of the stoichiometric requirement of the total acid content of the binder component, said precipitant comprising at least one substance selected from the group consisting of calcium carbonate, dolomite, magnesium oxide, magnesium hydroxide, magnesium carbonate and zinc oxide as cationic metal oxides precursors of these and cationic metal oxides, said precipitant being substantially non-fluxing with the foundry sand, and substantially non-reactive with respect to other mould components than the said acid, and substantially non-reactive with respect to metal which is to be cast in the mould. The precipitant is preferably zinc oxide, and the binder component may further include at least one humectant (e.g. sorbitol) admixed with the remainder to retard the loss of mould tensile strength during periods of low humidity. When acetic and propionic acids are used, they may be provided as an acid precursor in the form of an anhydride of the acid.

6 Claims, No Drawings

METHOD OF MANUFACTURING A FOUNDRY MOULD MIX CONTAINING A MOULD BINDER

This application is a continuation-in-part of application Ser. No. 419,506, filed Sept. 19, 1982, and now abandoned.

This invention relates to a method of manufacturing a foundry mould mix containing a mould binder.

It has been proposed in U.S. Pat. No. 4,235,633, dated Nov. 25, 1980, "Dental Compositions", K. Tomioka and S. Futami, to add an organic, such as acetic acid, as an auxiliary component to improve the setting rate and state of a dental composition comprising liquid acid phosphates and reactive multivalent metallic salts. In, for example, steel casting, there would be a danger of phosphorous pick up if acid phosphates were used in a mould binder, and this would be detrimental to the steel in that the properties of the casting would be impaired.

It has also been proposed in Canadian Pat. No. 1,099,077, dated Apr. 14, 1981, "Method of producing a foundry mold for casting molten metal", E. I. Szabo, to form a foundry sand containing 2 to 6 weight % of at least one alkaline earth oxide (e.g. magnesium oxide), and then to convert the alkaline earth oxide to alkaline earth oxalate and thus provide a binder for the foundry sand.

While this method as described has proved useful in the preparation of foundry moulds, moulds of greater mechanical strength may be prepared by using a substance which may be prepared in solutions of higher concentrations than possible with oxalic acid, or using a substance (or substances) which are liquid at the temperature of interest. In addition to the improved mechanical strength to be had by this approach, additional benefits may accrue, inasmuch as the lesser amount of fluid that is to be incorporated in the moulding mix reduces sticking between the sand and the pattern.

Thus, there is a foreseeable need for a foundry mould binder substance for mixing with foundry sand, which is available as a fluid in high concentrations (or is fluid at the temperature of interest) so that only little or no excess solvent is present to effect the mould strength adversely and to increase stickinee between the moulding sand and the pattern.

According to the present invention, there is provided a method of manufacturing a foundry mould mix containing a mould binder, comprising, (a) mixing a binder with foundry sand in the range 15 to 150 grams of binder per kilogram of foundry sand, the binder consisting essentially of:
  (i) at least one monobasic acid selected from the group consisting of formic acid, acetic acid, propiolic acid, propionic acid, and acrylic acid;
  (ii) a precipitant for the binder component, the amount of precipitant present being equivalent to at least 50% of the stoichiometric requirement of the total acid content of the binder components, said precipitant comprising at least one substance selected from the group consisting of calcium carbonate, dolomite, magnesium oxide, magnesium hydroxide, magnesium carbonate and zinc oxide as cationic metal oxides and precursors of these cationic metal oxides, said precipitant being substantially non-fluxing with the foundry sand, and substantially non-reactive with respect to metal which is to be cast in the mould, and (iii) water, the water being present in an amount no greater than 1.5 times the total weight of the acid component, calculated on that acid component being in a water free state.

At least one of the acetic and propionic acids may be provided as an acid precursor in the form of an anhydride of the acid.

The precipitant is preferably zinc oxide.

The binder may contain an amount of precipitant equivalent to at least 200% of the stoichiometric requirement of the total acid content at least 200% of the stoichiometric requirement of the total acid content of the binder components.

The mould binder may further comprise at least one humectant admixed with the reminder.

Preferably the humectant is sorbitol.

EXAMPLES OF PREFERRED PRECIPITANTS (i) Caclium carbonate (limestone) having particles in size 0 w/o retained on 140 mesh screen and 20 w/o retained on 325 mesh screen.
(ii) Crushed dolomite in particulate form.
(iii) Magnesium oxide (preferably that marketed as grade USP heavy).
(iv) Magnesium hydroxide in particulate form.
(v) Precipitated magnesium carbonate.
(vi) Zinc oxide in particulate form, preferably in the known form of as a precipitate from a fume process.
(vii) Lithium carbonate in particulate form.

EXAMPLES OF PREFERRED HUMECTANTS (i) Glycerol—(1,2,3 propanetriol)
(ii) Sorbitol—a (1,2,3,4,5,6 hexanehexol) or glucitol (1,2,6 hexanetriol)
(iii) Triethylene glycol—(2,2' ethylenedioxydiethanol)
(iv) Trimethylene glycol or Propylene glycol—(1,2 propanediol)

It will be appreciated that where the dissociation constant of the acid is lower than that of the anion to be displaced from an oxide precursor, precipitation will not take place. Hence, the selection of the appropriate acid and that of the precipitant has to be made bearing this in mind.

The following reactions may be used to yield a foundry mould binder according to the present invention:

$$ZnO+2CH_3\text{-}COOH+H_2O \rightarrow Zn(OOC\text{-}CH_3)_2.2H_2O \quad (1)$$

the water of the reaction will be taken up by the acetate forming a hydrated compound:

$$2ZnO+2CH_3\text{-}COOH+H_2O \rightarrow Zn_2O(OOC\text{-}CH_3)_2.2H_2O \quad (2)$$

the result is a basic acetate:

$$Zn(OOC\text{-}CH_3)_2.2H_2O+ZnO \rightarrow Zn_2O(OOC\text{-}CH_3)_2+2H_2O \quad (3)$$

again resulting in the basic acetate.

Initial tests to verify the present invention were made with mixtures of zinc oxide with zinc acetate solution or with varying amounts of acetic acid and led to the formation of solids, which, when mixed with a foundry sand, succeeded in bonding the moist (wet) mass into a monolithic lump.

It was noted, for instance, that zinc acetate solutions were less effective hardeners than moderately diluted solutions of acetic acid, owing to the lower concentration of reactants, the upper limit of which was determined by the solubility of zinc acetate.

It was found that, to react one gram mole f zinc oxide with the stoichiometrically equivalent amount of zinc acetate a minimum of 528 mL of water must also be included with the system. It was also found that some, but likely not all, of this water may be incorporated within the structure of the precipitate formed, but the bonds are likely to be tenuous and the composition influenced by atmospheric conditions, i.e. the basic zinc acetate forms an initial hydroxy acetate of varying and variable composition, the final equilibrium of which is dependent upon atmospheric humidity and temperature.

In the total absence of water from mould binders, according to the present invention, no reaction takes place and so the binder components, other than the water, may be stored in a premixed condition and activated when desired by adding the water component thereto.

When the water component is present in an amount in excess of 1.5 times the total weight of the acid content, calculated on the acid content being in a water free state, the mould so produced is unduly weakened by excess water.

In other tests, small mixes were prepared including a number in sufficient amounts to make small step-block moulds. The acid was added in the form of its anhydride with sufficient water in excess to ensure complete hydrolysis and supply possible requirements for the formation of hydroxy compounds. Initially, four moulds were made as follows:

TABLE 1

| Basic Zinc Acetate Bonded Moulds | |
|---|---|
| Sand | 15,000 g |
| ZnO | 600 g |
| Acetic anhydride | 450 g |
| + Water to | 1 L total volume. |

The four moulds were allowed to harden, and before closing, one was left untreated while the other three were coated with mould wash as follows:

(i) one was sprayed with a saturated solution of zirconyl chloride in methanol;

(ii) another was given a coat with a mould wash marketed under the trademark "Ceramol" by Foseco (Canada) Ltd., Guelph, Ontario, Canada; and (iii) one received a dual treatment of zirconyl chloride spray followed by the application of the moule wash "Ceramol".

When dry, the moulds were closed and subsequently filled with molten grey iron at 1400° C. The pour was quiet; slight to moderate flaming was noted, which was thought to be caused by acetic acid and its pyrolysis products.

When cool, the moulds were shaken out and the castings examined. Pronounced erosion was evident in the uncoated mould together with collapse of the cope. Marked improvement was achieved with zirconyl chloride solution-coated mould. The commercial mould wash coating proved similarly beneficial. The combined application of zirconyl chloride coating followed by the commercial mould wash coating yielded a casting with superior surface finish.

I claim:

1. A method of manufacturing a foundry mould mix containing a mould binder comprising:

(a) mixing a binder with foundry sand in the range 15 to 150 grams of binder per kilogram of foundry sand, the binder consisting essentially of:

(i) at least one monobasic acid selected from the group consisting of formic acid, acetic acid, propiolic acid, propionic acid, and acrylic acid;

(ii) a precipitant for the acid, the amount of precipitant present in the binder components being equivalent to at least 50% of the stoichiometric requirement of the total acid content of the binder components, said precipitant comprising at least one substance selected from the group consisting of calcium carbonate, dolomite, magnesium oxide, magnesium hydroxide, magnesium carbonate and zinc oxide, said precipitant being substantially non-fluxing with foundry sand, and substantially non-reactive with respect to other mould components than the said total acid content, and substantially non-reactive with respect to metal which is to be cast in the mould, and (iii) water, the water being present in an amount no greater than 1.5 times the weight of total acid content, calculated on that acid component being in a water free state.

2. A method according to claim 1, wherein at least one of the acetic and propionic acids are provided as an acid precursor in the form of an anhydride of the acid.

3. A method according to claim 1 wherein the precipitant is zinc oxide.

4. A method according to claim 1 wherein the amount of precipitant is in an amount equivalent to at least 200% of the stoichiometric requirement of the total acid content of the binder components.

5. A method according to claim 1 which further includes mixing at least one humectant with the binder components.

6. A method according to claim 5 wherein the humectant is sorbitol.

* * * * *